US007963633B2

(12) United States Patent
Oikawa et al.

(10) Patent No.: US 7,963,633 B2
(45) Date of Patent: Jun. 21, 2011

(54) INK JET RECORDING HEAD AND INK JET RECORDING APPARATUS

(75) Inventors: Masaki Oikawa, Inagi (JP); Mineo Kaneko, Tokyo (JP); Ken Tsuchii, Sagamihara (JP); Toru Yamane, Yokohama (JP); Keiji Tomizawa, Yokohama (JP); Mitsuhiro Matsumoto, Yokohama (JP); Shuichi Ide, Tokyo (JP); Kansui Takino, Kawasaki (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 852 days.

(21) Appl. No.: 11/936,227

(22) Filed: Nov. 7, 2007

(65) Prior Publication Data

US 2008/0143786 A1 Jun. 19, 2008

(30) Foreign Application Priority Data

Nov. 9, 2006 (JP) ..... 2006-304174

(51) Int. Cl.
*B41J 2/14* (2006.01)

(52) U.S. Cl. ..... 347/47

(58) Field of Classification Search ..... None
See application file for complete search history.

(56) References Cited

U.S. PATENT DOCUMENTS

| | | | | |
|---|---|---|---|---|
| 4,746,935 | A * | 5/1988 | Allen | 347/98 |
| 5,218,376 | A | 6/1993 | Asai | |
| 6,155,673 | A | 12/2000 | Nakajima et al. | |
| 6,830,317 | B2 | 12/2004 | Tsuchii et al. | |
| 6,846,064 | B2 | 1/2005 | Yamane | |
| 6,976,748 | B2 | 12/2005 | Yabe et al. | |
| 7,393,081 | B2 * | 7/2008 | Maekawa et al. | 347/40 |
| 2004/0218007 | A1 | 11/2004 | Tomizawa et al. | |
| 2008/0001994 | A1 | 1/2008 | Kaneko | |
| 2008/0012898 | A1 | 1/2008 | Tsuchii et al. | |
| 2008/0055368 | A1 | 3/2008 | Oikawa et al. | |

FOREIGN PATENT DOCUMENTS

| | | |
|---|---|---|
| JP | 4-010940 | 1/1992 |
| JP | 2004-001491 | 1/2004 |

* cited by examiner

*Primary Examiner* — Omar Rojas
(74) *Attorney, Agent, or Firm* — Fitzpatrick, Cella, Harper & Scinto

(57) ABSTRACT

An ink jet recording head and an ink jet recording apparatus are provided to prevent occurrence of a white line or recording unevenness due to a head tilt, and realize a high image quality recording. For this purpose, in a recording head provided with nozzles ejecting three types of droplets, a large droplet, medium droplet and small droplet, nozzles are configured such that no nozzles are arranged on the same line at the centers thereof in the main scanning direction.

9 Claims, 17 Drawing Sheets

INK JET RECORDING HEAD AND INK JET RECORDING APPARATUS

BACKGROUND OF THE INVENTION

1. Field of the Invention

The present invention relates to an ink jet recording head for recording by ejecting ink to a recording medium.

2. Description of the Related Art

Recently, a number of recording apparatuses have been used, and high speed, high resolution, high image quality, low noise, etc., are required for these recording apparatuses. Recording apparatuses which meet these requirements include an ink-jet type recording apparatus (hereinafter, referred to as ink jet recording apparatus). An ink jet recording apparatus is configured to eject ink (recording liquid) droplets from recording head ejectors, and to perform recording by letting these ink droplets adhere to a recording medium. In this ink jet recording apparatus, since recording is performed by means of ink ejection from a recording head, recording can be performed without any contact to a recording medium to realize an extremely stable recording image.

FIG. 8 is a perspective view showing a conventional ink jet recording head, a part of which is cut out. The ink jet recording head includes a heater 1, which is an electro-thermal conversion element corresponding to each ejector 4, and a separator wall for forming each independent nozzle 5, which is a flow path of ink, is provided to extend from the ejector 4 to a vicinity of a supply chamber 6. Such a recording head has an ink ejecting device according to an ink jet recording method disclosed in Japanese Patent Laid-Open No. H4-10940, and is configured such that an air bubble generated at an ink ejection is conducted to outside air via an ejector.

Factors for judging a recording quality include a granularity. An outstanding granularity in a recording output reduces a recording quality thereof. Therefore, in order to make granularity unnoticeable, a conventional recording method proposes to provide nozzles ejecting ink droplets with different sizes, and to perform recording using a small ink droplet for a portion with a bright-tone to a half-tone in an image and to perform recording using a large ink droplet for a portion with a half-tone to a dark-tone.

Also, Japanese Patent Laid-Open No. 2004-1491 proposes to arrange nozzles ejecting large and small ink droplets symmetrically in the main scanning direction, in which an ink jet recording head scans, for averaging an effect of air flow to a flying ink droplet by realizing a bi-directional recording to improve an image quality.

FIG. 9 is a diagram showing a nozzle arrangement disclosed in Japanese Patent Laid-Open No. 2004-1491. A nozzle column 15 ejecting a large droplet and a nozzle column 16 ejecting a small droplet are arranged with the same nozzle pitch, respectively, and the large and small nozzles are arranged to be shifted by half a nozzle pitch each other. Further, for a symmetrical arrangement of nozzles, an additional column is arranged for respective large and small nozzles and the large and small nozzle columns are arranged to be shifted by half a nozzle pitch each other. Such a symmetrical configuration of large and small nozzle columns is applied for only cyan and magenta and a configuration with only a large nozzle column is applied for yellow. Although nozzles with the same ejection amount are actually shifted by half a pitch between left and right in FIG. 9, this arrangement is assumed here to be symmetrical for convenience.

In a case such a configuration having large and small nozzles in symmetry is employed, many nozzles are arranged along the main scanning direction of an ink jet recording head (hereinafter, also referred to simply as "recording head") and the width of the ink jet recording head becomes large. When a recording head with a large width is attached to a recording apparatus being tilted and recording is performed in this situation, a shift of an ink droplet landing position by the tilt becomes significant and appears in a recording result.

FIG. 10 is a schematic plan view showing an arrangement state of two types of nozzles, large and small, ejecting ink with each color arranged along the main scanning direction in a recording head. In FIG. 10, a CL column A, CS column A, CS column B and CL column B, which are allocated near the both ends of the recording head in the main scanning direction, are nozzle columns for ejecting cyan ink. In this case, the distance between the nozzles at the both ends, that is, CL column A and CL column B, is 6 mm.

FIG. 11A is a diagram showing positional relationships of ink droplets at landing for recording by the CL column A, CS column A, CS column B and CL column B, column by column for easy understanding, in a case a recording head is not tilted. FIG. 11B is a diagram showing an appearance of landed ink droplets in a case the recording head is not tilted. FIG. 11C is a diagram showing positional relationships of ink droplets at landing, column by column for easy understanding, in a case a recording is performed with the recording head tilted by approximately 0.2 degree, and FIG. 11D is a diagram showing an appearance of landed ink droplets in a case with the recording head in a tilted state.

When the recording head is not tilted, ejected ink droplets land on a recording medium approximately at positions according to a nozzle arrangement as shown in FIG. 11A and the ink droplets fill a recording area uniformly as shown in FIG. 11B.

On the other hand, when the recording head is tilted, ejected ink droplets land at positions in a state tilted different from arrangement of each nozzle as shown in FIG. 11C. As a result, portions where ink droplets ejected from the CL column A and CL column B overlap each other come to increase and a recording area in a recording medium can not be filled with ink droplets sufficiently, resulting in that a white line will appear in a recoding result as shown in FIG. 11D. This phenomenon is apparent in a case where a diameter of a small nozzle is as small as one third of that of a large nozzle and a nozzle pitch is large, and a recording unevenness with a particular period, caused by a periodical change of a recording head tilt during scanning, further worsens the problem.

SUMMARY OF THE INVENTION

Accordingly, the present invention is achieved in view of the above point, and an object thereof is to provide an ink jet recording head and an ink jet recording apparatus wherein a white line caused by a head tilt and a recording unevenness can be prevented from occurring and a high image quality recording can be realized.

An ink jet recording head, which can be mounted on a carriage of a recording apparatus movable in a main scanning direction and is provided with a plurality of nozzles capable of ejecting ink, the nozzles being arranged in the main scanning direction and in a sub-scanning direction crossing the main scanning direction, the plurality of nozzles comprising a first, a second, and a third nozzles in order of largest ink ejection capacity to smallest, wherein: the first nozzles form a nozzle column at one end and a nozzle column at the other end located apart from each other in the main scanning direction; the second and third nozzles form middle nozzle columns located between the nozzle column at one end and the nozzle column at the other end; a pitch of the second and third nozzles forming the middle nozzle columns is smaller than that of the first nozzles forming the nozzle column at one end and the nozzle column at the other end; a sum of a total number of the second nozzles and a total number of the third nozzles is larger than a total number of the first nozzles; centers of the first nozzles forming the nozzle column at one end and centers of the first nozzles forming the nozzle column at the other end are located to be shifted each other in the sub-scanning direction; and centers of the first, second, and third nozzles are located to be shifted one another in the sub-scanning direction.

According to the present invention, a white line and a recording unevenness are not caused and a high image quality recording result can be obtained, when nozzles are configured such that the centers of nozzles with different ejection amounts are not allocated on a line in the main scanning direction in a recording head provided with nozzles ejecting three types of droplets, large, medium and small in an ejection amount.

Further features of the present invention will become apparent from the following description of exemplary embodiments (with reference to the attached drawings).

DESCRIPTION OF THE EMBODIMENTS

First Embodiment

Hereinafter, a first embodiment of the present invention will be described in detail in reference to the drawings.

Figure 1:
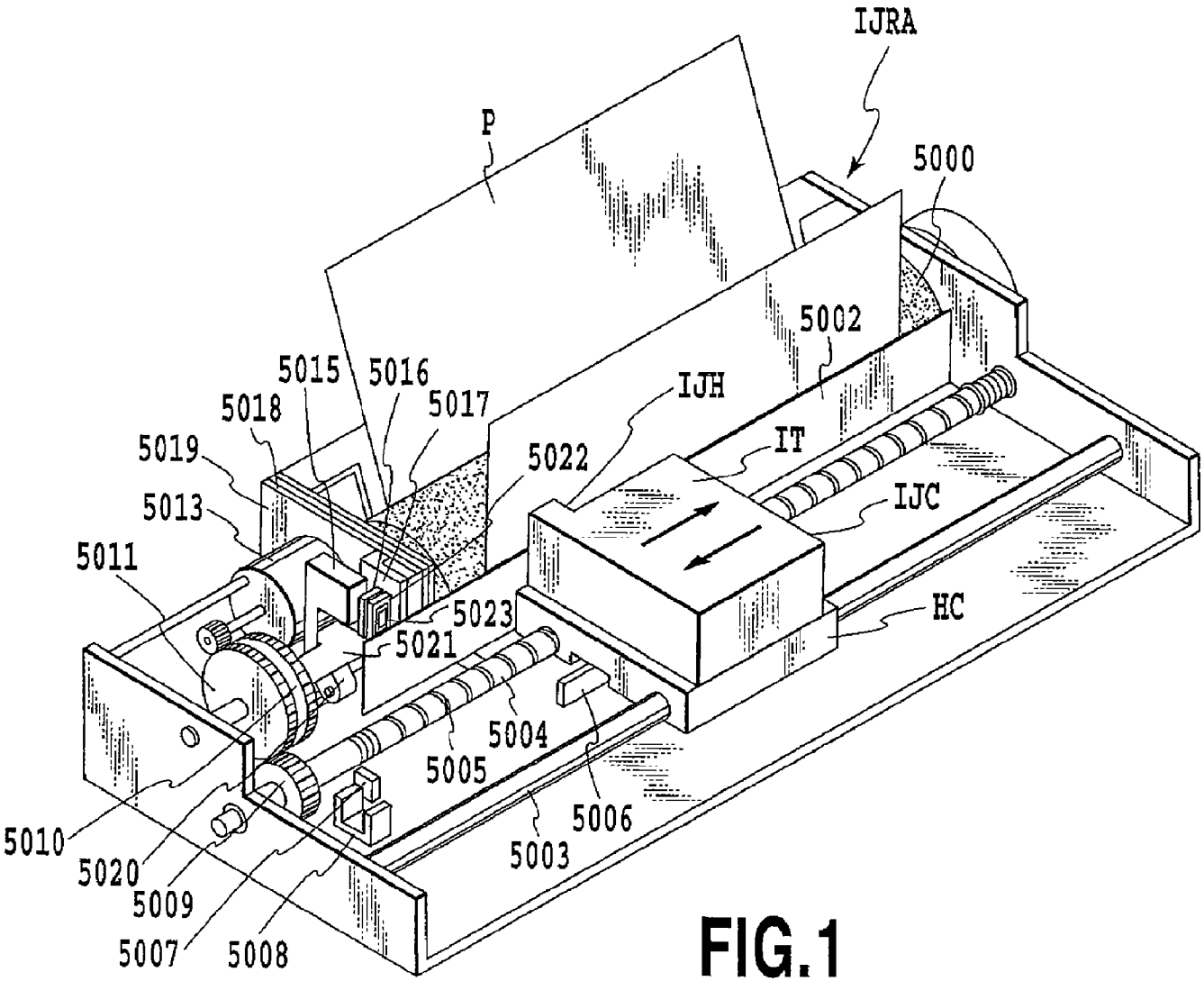
FIG. 1 is a perspective appearance view showing a configuration of an ink jet recording apparatus according to an embodiment of the present invention.

FIG. 1 is a perspective appearance view showing a configuration of an ink jet recording apparatus IJRA according to an embodiment of the present invention. In FIG. 1, a carriage HC, engaged with a spiral groove 5004 of a lead screw 5005 rotating via driving force transmission gears 5009 to 5011 for transmitting rotation of a driving motor 5013, has a pin (not shown in the drawing) and is supported by a guide rail 5003 to reciprocate in directions of arrows a and b. An integrated inkjet cartridge IJC incorporating a recording head IJH and an ink tank IT is mounted on the carriage HC. Also, a main supporting board 5018 of the ink jet recording apparatus IJRA supports a paper pressing board 5002 for pressing a recording media P against a platen 5000 across a moving direction of the carriage HC. Further, the main supporting board 5018 supports photo-couplers 5007 and 5008 which are home-position detectors for performing such as switching of a rotation direction of a motor 5013 by confirming existence of a carriage lever 5006. Further, the main supporting board 5018 supports a member 5016 supporting a cap member 5022 for capping an ink ejection surface of a recording head IJH, a sucking device 5015 for sucking-and-restoring the recording head, and a member 5019 for enabling a cleaning blade 5017 to move back and forth. Regarding the cleaning blade 5017, it is obvious that another well known cleaning blade can be applied to the present example rather than that in this shape. Also, a lever 5021 for starting a suck of the sucking-and-restoring operation, which is provided on the main supporting board 5018, moves according to a movement of a cam 5020 engaged with the carriage, and the driving force of the driving motor is moved and controlled by a publicly known transmission mechanism such as clutch switching.

While these operations of capping, cleaning, and sucking-and-restoring are configured such that a required process is performed by a function of the lead screw 5005 when the carriage comes to a region on the home position side, the operations may be performed at required timings.

Figure 2:
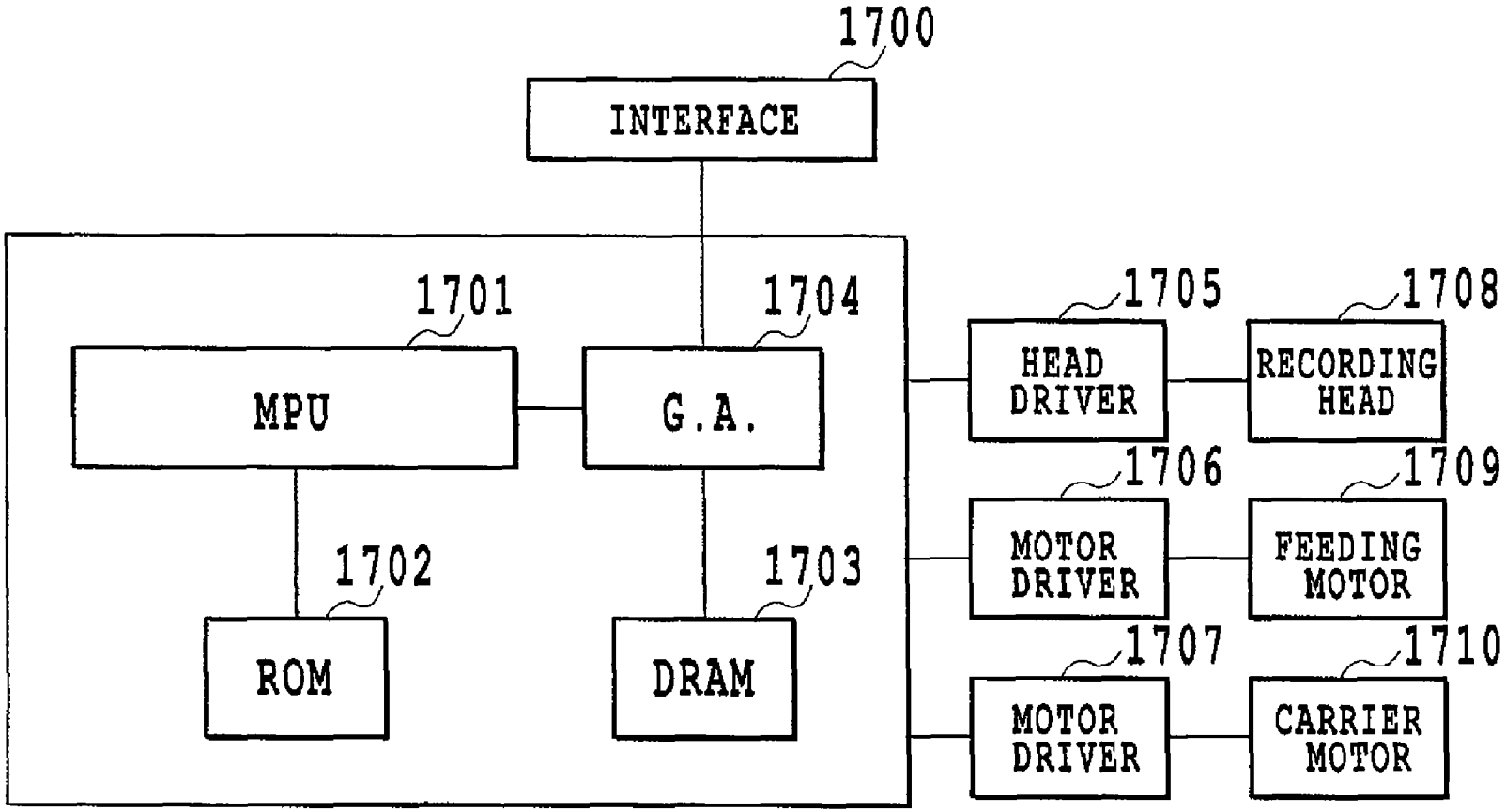
FIG. 2 is a block diagram showing a configuration of a control circuit for the ink jet recording apparatus.

FIG. 2 is a block diagram showing a configuration of a control circuit for an ink jet recording apparatus IJRA. The control circuit includes an interface 1700 for receiving a recording signal, a ROM 1702 storing a control program executed by an MPU 1701, a DRAM 1703 storing various data (above mentioned recording signal, recording data to be supplied to a recording head IJH, etc.) and the like. A gate array (G.A.) 1704 for controlling supply of the recording data to the recording head IJH also controls data transfer between the interface 1700, the MPU 1701 and the RAM 1703. Also, as a driver for driving each motor, there are provided a head driver 1705 for driving the recording head IJH, and motor drivers 1706 and 1707 for driving a feeding motor 1709 and carrier motor 1710, respectively.

When a recording signal is input into the interface 1700, the recording signal is converted into recording data for printing between the gate array 1704 and the MPU 1701. Then, at the same time when the motor drivers 1706 and 1707 are driven, the recording head IJH is driven according to the recording data transmitted to the head driver 1705 and recording is performed.

Figure 3A:
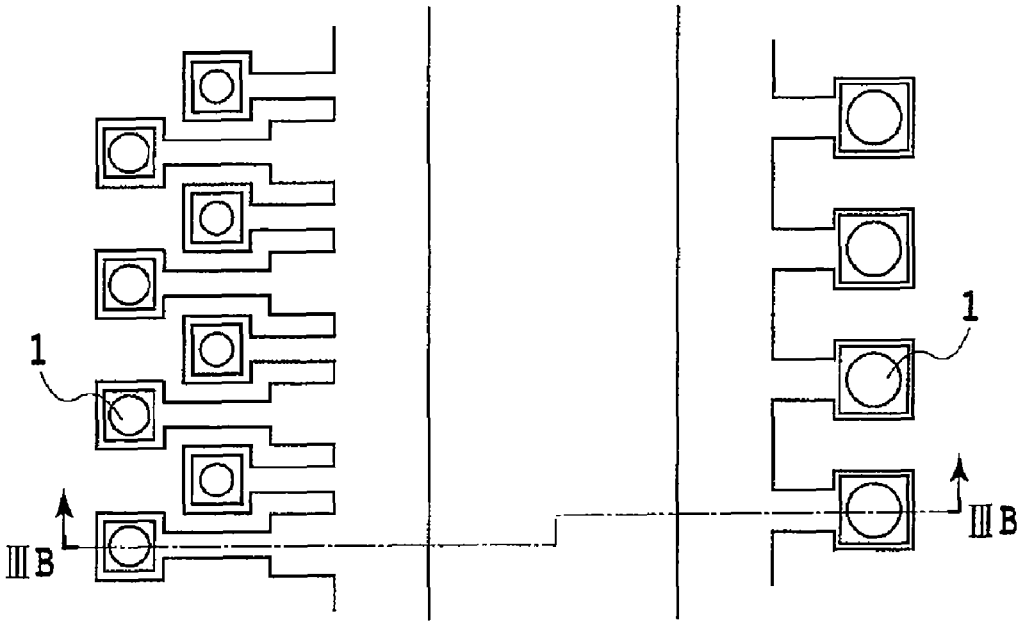
FIG. 3A is an enlarged diagram showing nozzle columns with columns of heating elements.
Figure 3B:
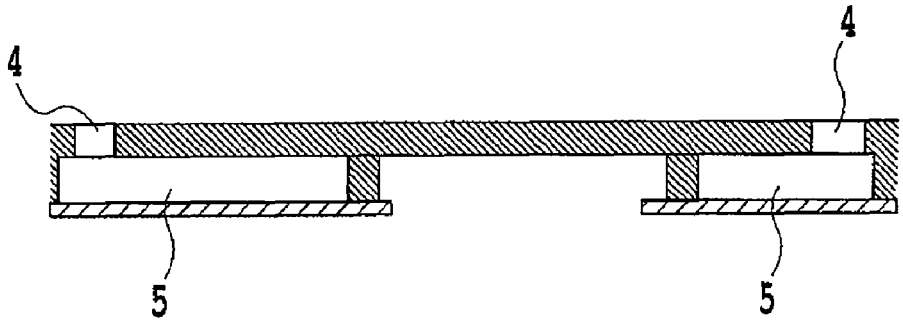
FIG. 3B is a schematic cross-sectional view taken along the line A-A in FIG. 3A.

FIG. 3A is an enlarged view of a part of nozzle columns with columns of heating elements. FIG. 3B is a schematic cross-sectional view taken along the line A-A in FIG. 3A. In an ink jet recording head according to FIGS. 3A and 3B, a separation wall which makes each of heating elements (heaters) 1 and nozzles 5, being ink flow paths, to be formed individually and independently is configured to extend from the ejector 4 to a vicinity of a supply chamber. In the present embodiment, there are provided nozzles ejecting droplets with three types of amounts, large, medium and small, and the nozzles are configured to be able to eject an ink droplet of 2 to 5 pl for a large droplet, an ink droplet of 1 to 2 pl for medium droplet and an ink droplet of no more than 1 pl for a small droplet. In the present embodiment, an ejection amount of each nozzle is determined selectively within these ranges of ejection amounts such that an ejection amount for a large droplet is not less than two times ejection amounts for medium and small droplets. For example, the ejection amount is selectively determined to be such as 2 pl for a medium droplet and 1 pl for a small droplet in a case of a 5 pl large droplet, or 1 pl for a medium droplet and 0.5 pl for a small droplet in a case of a 3 pl large droplet. In this manner, by use of three types of ejection droplet amounts, it is possible to realize a high image quality recording with an excellent expression in a half-tone and good gradation characteristics.

Figure 4:
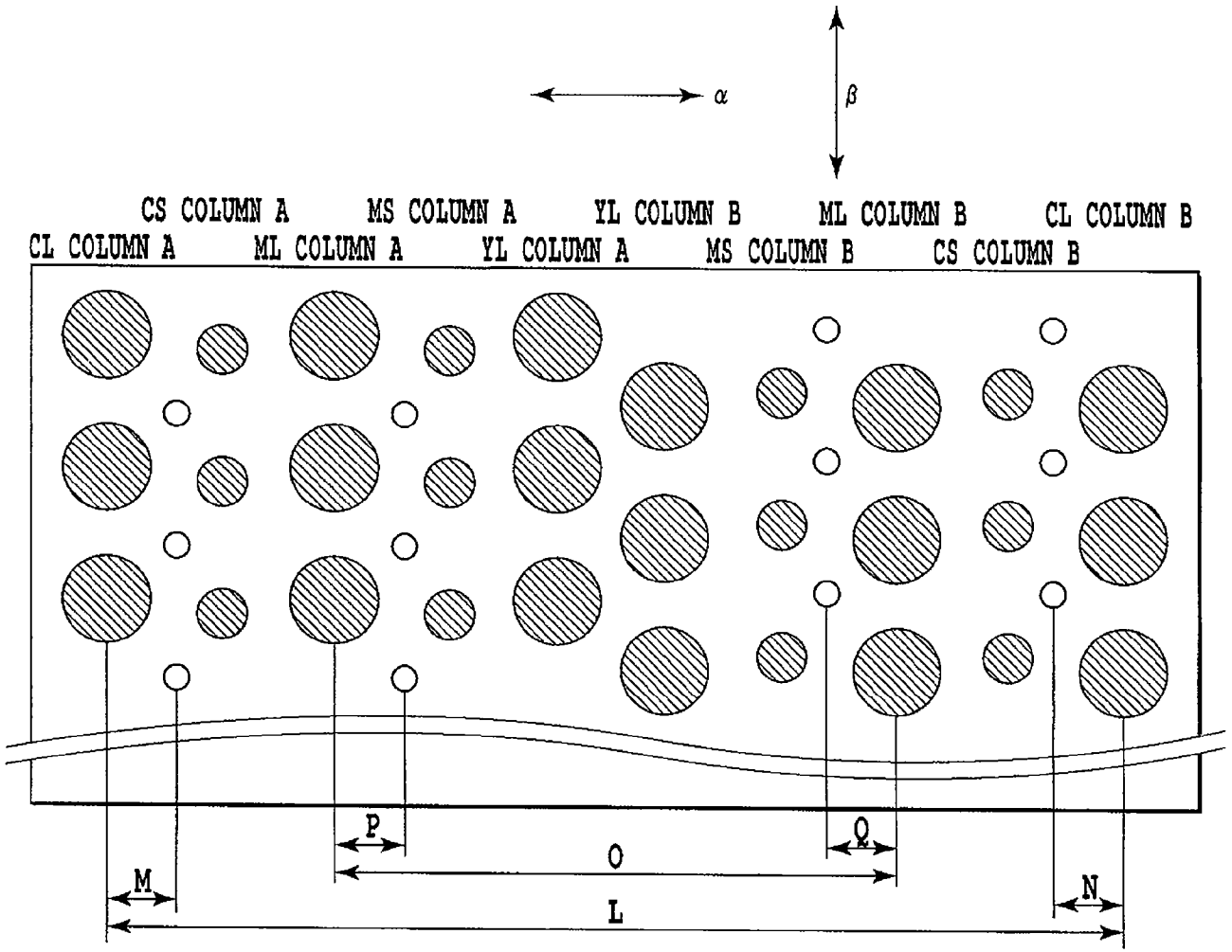
FIG. 4 is a diagram showing an arrangement of nozzles in an ink jet recording head according to a first embodiment.

FIG. 4 is a schematic diagram showing a nozzle arrangement in an ink jet recording head according to the present embodiment. There are provided CL columns and CS columns for ejecting cyan ink, ML columns and MS columns for ejecting magenta ink, and YL columns for ejecting yellow ink. For ejecting yellow ink, there is provided only nozzles ejecting a large droplet and there are not provided nozzles ejecting a medium and small droplet. Also, in the recording head according to the present embodiment, nozzle columns for each color are arranged symmetrically as shown in FIG. 4, except that left and right nozzles are arranged with an offset in the sub-scanning direction (in the direction of an arrow β).

In the present embodiment, a distance L between a CL column A and a CL column B arranged at the most distant positions is approximately 6 mm, and a distance M between the CL column A and a CS column A and a distance N between the CL column B and a CS column B is approximately 0.25 mm. Also, a distance O between an ML column A and an ML column B ejecting magenta ink is approximately 3 mm, and a distance P between the ML column A and an MS column A, and a distance Q between the ML column B and an MS column B is approximately 0.25 mm. Also, nozzles located on the same side of the recording head ejecting ink with the same color are arranged such that the distance between a nozzle ejecting a large droplet and a nozzle ejecting a small droplet is shorter than the distance between a nozzle ejecting a large droplet and a nozzle ejecting a medium droplet.

In this manner, a distance between nozzles ejecting large droplets in nozzle columns ejecting ink with the same color and arranged symmetrically (nozzle positions have an offset) is configured to be not smaller than ten times a distance between a nozzle ejecting a large droplet and a nozzle ejecting a small droplet. The present invention is effective to a recording head with such a configuration.

Figure 5:
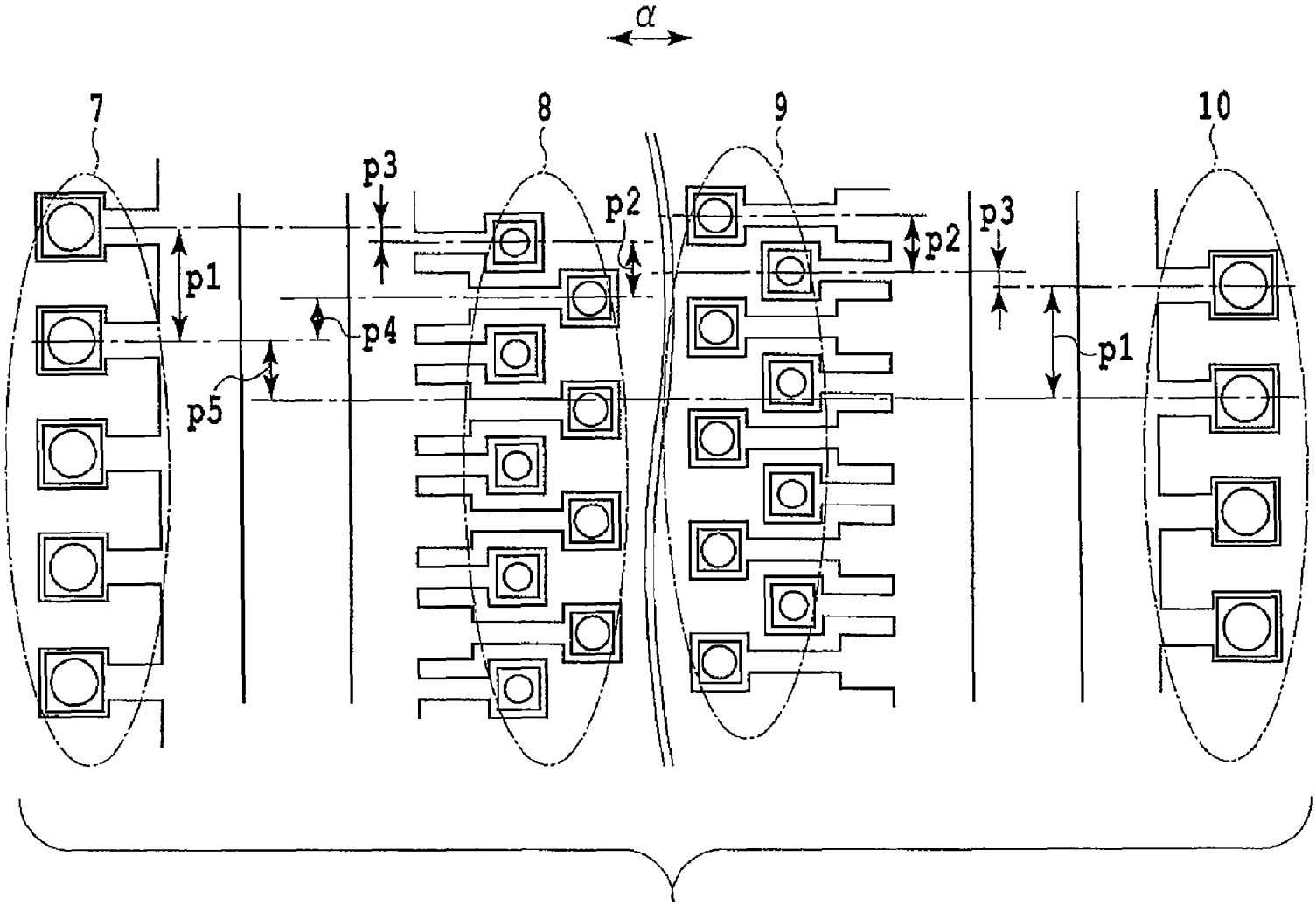
FIG. 5 is an enlarged view of the nozzle columns ejecting cyan ink in FIG. 4.

Also, FIG. 5 is an enlarged view showing the CL column A, CS column A, CS column B, and CL column B ejecting cyan ink in FIG. 4 in an arrangement for an actual recording head. As shown in FIG. 5, the recording head is provided with a first nozzle column 7 arranged to be perpendicular to the main scanning direction (direction of an arrow α) at one end thereof, and a second nozzle column 8 at a position facing the first nozzle column 7 having a supply chamber therebetween. Further, the recording head is provided with a third nozzle column 9 at the other end thereof and a fourth nozzle column 10 at a position facing the third nozzle column 9 having a supply chamber therebetween (a nozzle column ejecting a small droplet and a nozzle column ejecting a medium droplet form an each single column of the nozzle column 8 and the nozzle column 9).

A nozzle pitch in the nozzle column 8 and nozzle column 9 is a half of that in the nozzle column 7 and nozzle column 10. Also, nozzle arrangements of the nozzle column 7 and nozzle column 10 are shifted from nozzle arrangements of the nozzle column 8 and nozzle column 9, and any nozzles are not arranged to overlap each other at the center thereof in the α direction. In the nozzle column 8 and nozzle column 9, nozzles can not be arranged in a single line as in the nozzle column 7 or nozzle column 10 because of a requirement from sizes of heating elements or flow paths and are arranged in a staggered manner. However, nozzles ejecting droplets with the same amount are arranged in a line in each of the nozzle column 8 and nozzle column 9 as in the nozzle column 7 and nozzle column 10.

The nozzle pitch P1 in the nozzle column 7 and nozzle column 10 is 42.3 μm (600 dpi). Also, the nozzle pitch p2 in the nozzle columns 8 and 9 (regarding the nozzle columns 8 and 9, the word "pitch" is used for convenience to mean a distance between centers of nozzles assuming that nozzles ejecting droplets with different amounts are arranged in a line alternately) is 21.2 μm (1,200 dpi). That is, the nozzle column 8 and the nozzle column 9 are provided with nozzles twice those in the nozzle column 7 and nozzle column 10. Also, an offset amount p3 of the nozzle column 8 against the nozzle column 7 is 5.3 μm (4,800 dpi), which is one fourth of the nozzle pitch in the nozzle column 8. Also, the nozzle column 10 has an offset against the nozzle column 7, and an offset amount thereof p5 is 21.2 μm (1,200 dpi).

Also, the nozzle column 8, which faces the nozzle column 7 ejecting a large droplet, is provided with nozzles ejecting medium and small droplet arranged alternately. An offset amount p3 in the sub-scanning direction between positions of a nozzle ejecting a small droplet and a nozzle ejecting a large droplet is 5.3 μm (size of one dot in 4,800 dpi). Then, an offset amount p4 in the sub-scanning direction between positions of a nozzle ejecting a medium droplet and a nozzle ejecting a large droplet is set to be as large as 15.9 μm (size of 3 dots in 4,800 dpi). This positional relationship between nozzles is similar between the nozzle column 9 and the nozzle column 10.

Ejector diameter of nozzles ejecting a medium droplet and small droplet provided in the nozzle column 8 and nozzle column 9 is not less than 5 μm and not more than 12 μm, and a pitch thereof is not less than 10 μm and not more than 30 μm. When a recording is performed using a recording head provided with each nozzle arranged in such a manner according to the present embodiment, a landing position of an ink droplet will be described for cases with and without a recording head tilted.

Figure 6A:
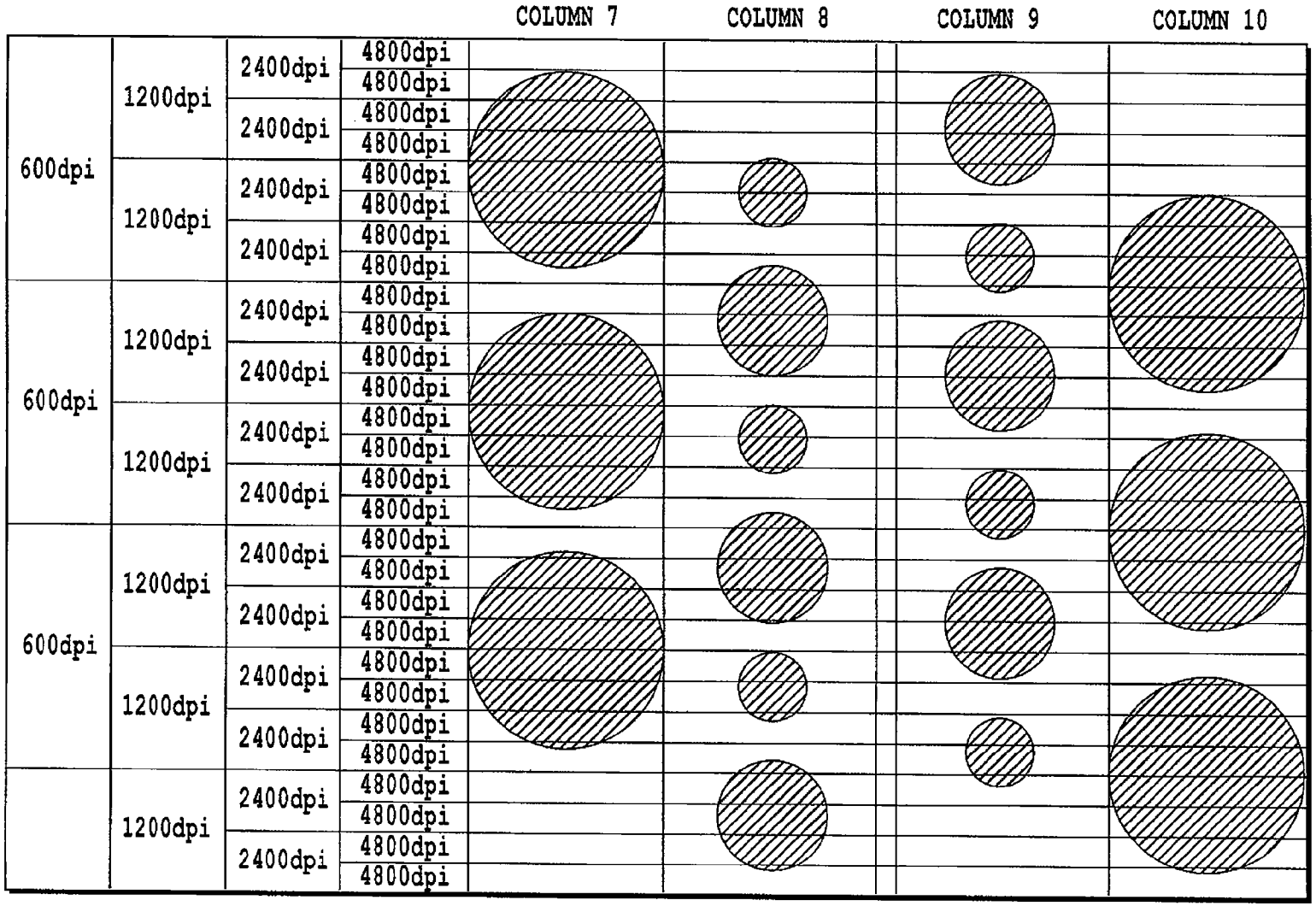
FIG. 6A is a diagram showing a positional relationship of landed ink droplets, column by column.
Figure 6B:
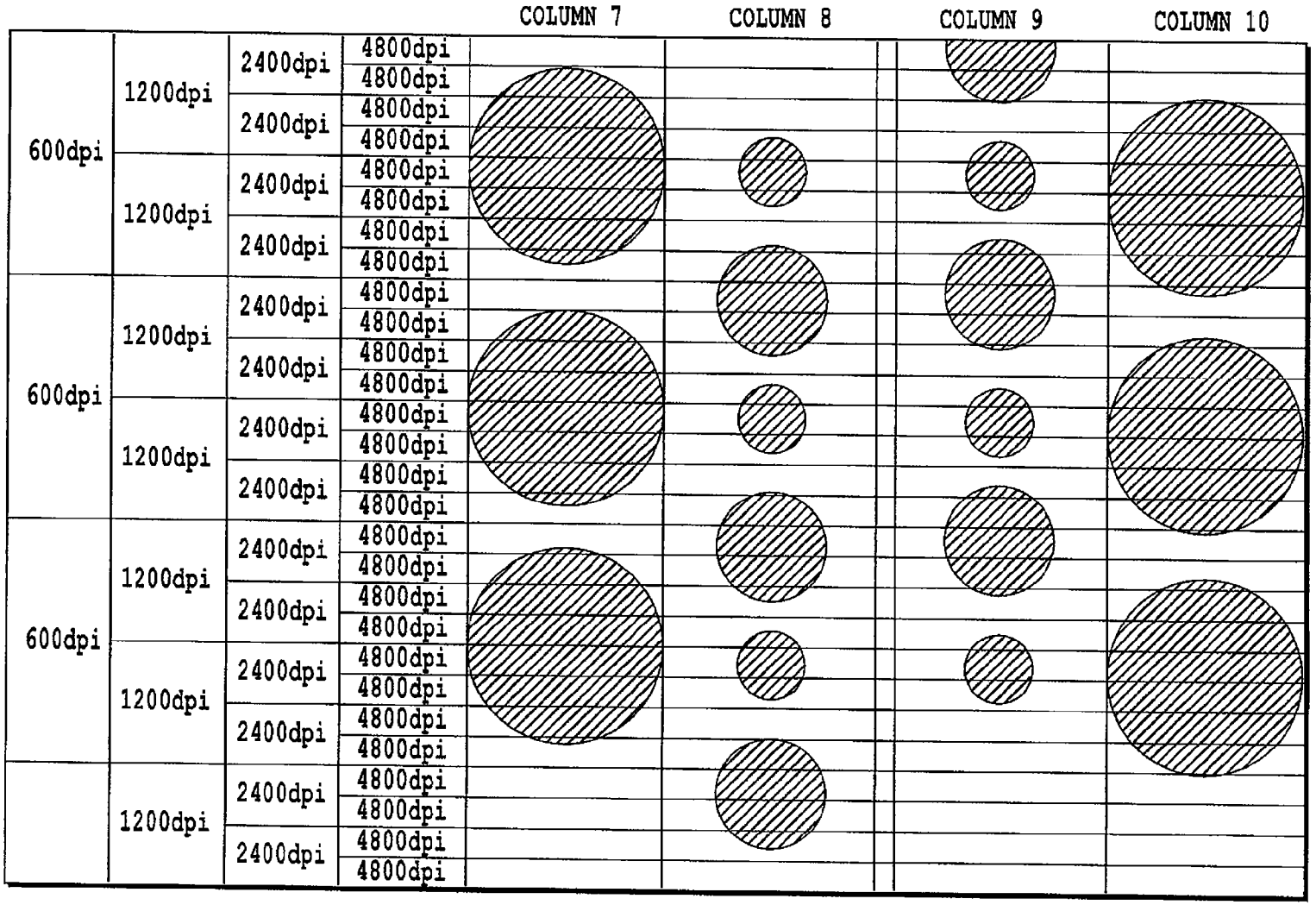
FIG. 6B is a diagram showing landed ink droplets when the recording head is not tilted.
Figure 6C:
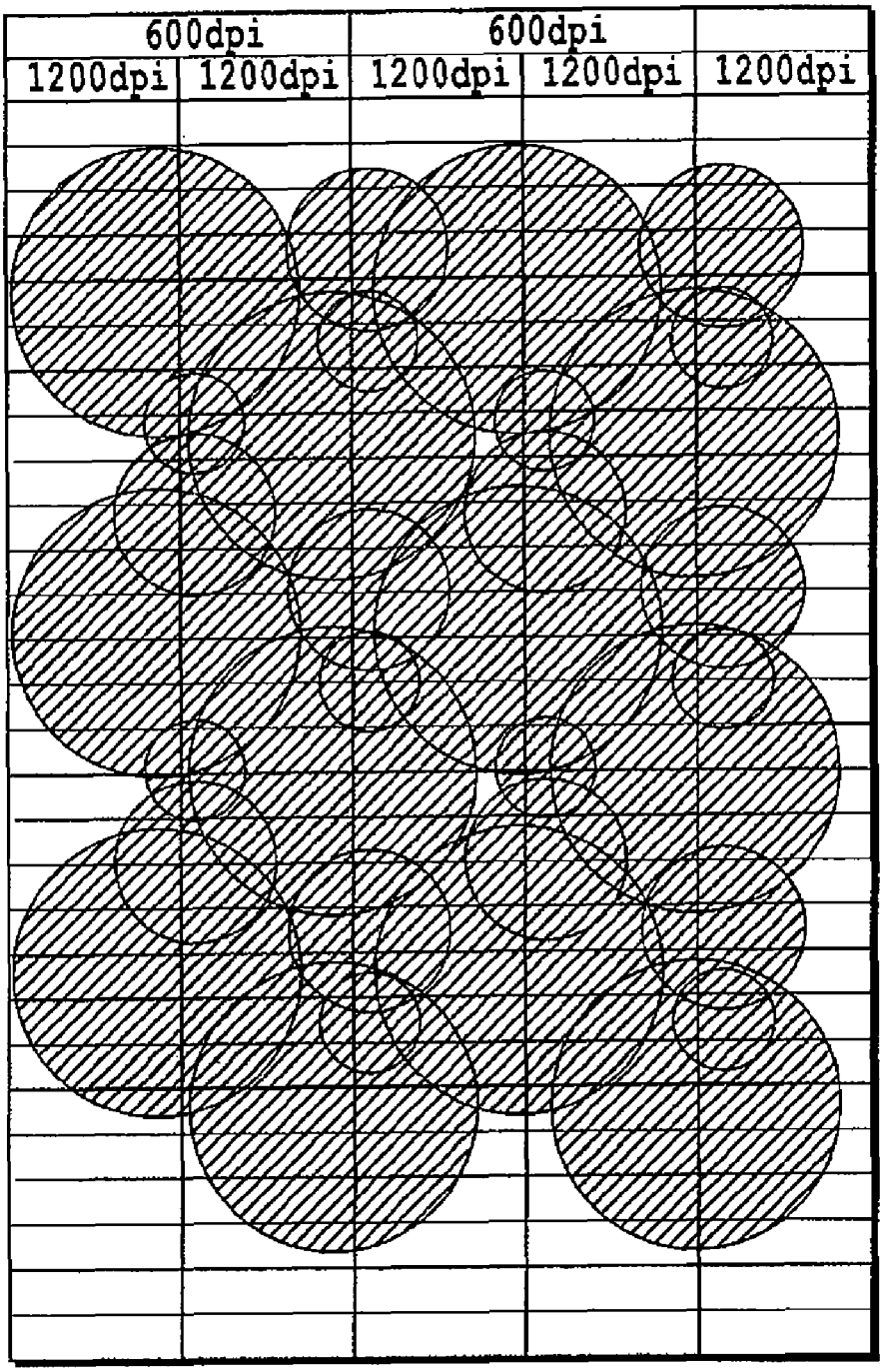
FIG. 6C is a diagram showing a positional relationship of landed ink droplets, column by column, when a recording is performed with the recording head tilted.
Figure 6D:
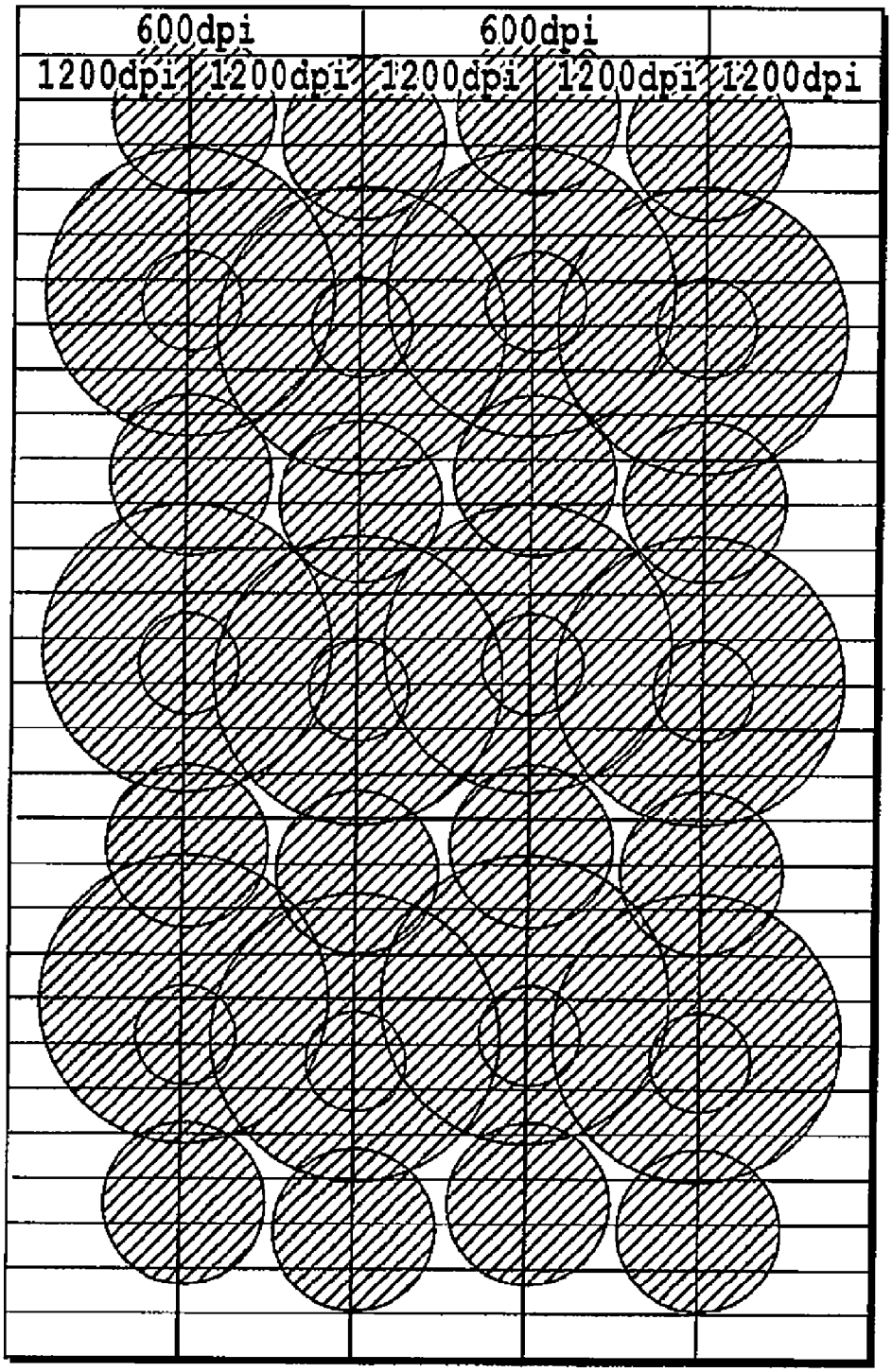
FIG. 6D is a diagram showing an appearance of landed ink droplets when the recording head is in a tilted state.

FIG. 6A is a diagram showing a positional relationship of ink droplets at landing, column by column for easy understanding, when the recording head is not tilted, and FIG. 6B is a schematic diagram showing an appearance of landed ink droplets when the recording head is not tilted. FIG. 6C is a diagram showing a positional relationship of ink droplets at landing, column by column for easy understanding, when a recording is performed with the recording head tilted by 0.2 degree, and FIG. 6D is a schematic diagram showing an appearance of landed ink droplets when the recording head is tilted.

Here, a column 7 in FIGS. 6A and 6C shows a landing state of droplets ejected from the nozzle column 7 in FIG. 5. Also, similarly, a column 8 in FIGS. 6A and 6C, a column 9 in FIGS. 6A and 6C, and a column 10 in FIGS. 6A and 6C show landing states of droplets ejected from the nozzle column 8, nozzle column 9, and nozzle column 10 in FIG. 5, respectively.

Nozzles for a small droplet and nozzles for a medium droplet are arranged in a staggered manner and ink droplets are to land with a shift in the scanning direction if ejection timings of the ink droplets are the same. However, it is possible to let the droplets land in a line as shown in FIG. 6A by adjusting a drive timing (drive raster).

Here, the value 0.2 degree, which is a tilt angle of a recording head used here, corresponds to the maximum angle of a recording head tilt generally encountered in ink jet recording apparatus. When a recording head tilts by an angle equal to 0.2 degree or more, a recording result will have a problem more serious than acceptable. Therefore, a recording head is usually configured such that a tilt angle thereof is suppressed under this value.

A recording result obtained in a case without a recording head tilt shows that droplets fill a recording area (area factor) almost uniformly as shown in FIG. 6B. Also, even in a case a recording is performed with a tilted recording head, as shown in FIG. 6D, a medium droplet fills a space between large droplets and a density distribution of ink droplet overlapping is approximately uniform as shown in FIG. 6D, resulting in an configuration where intensity non-uniformity is difficult to occur. (Although nozzles in the column 7 and column 8 will be described as an example hereinafter, a similar description can be applied to the nozzles in the column 10 and column 9, respectively.) That is, the number of nozzles in the column 8 is two times the number of nozzles in the column 7, and positions of the nozzles for the column 8 have an offset against positions of the nozzles in the column 7. Therefore, even if a droplet ejected from either one of nozzles with two types of different ejection amounts in the nozzle column in the column 8 overlaps with a landing position of a droplet ejected from a nozzle in the column 7, caused with a tilt of the recording head, the other droplet lands at a position which does not overlap with the landing position of a droplet ejected from a nozzle in the column 7, resulting in a uniform recording density. With such a configuration, in whichever direction the recording head is tilted, left or right, it is possible to obtain an effect of making uniform a recording density of a recording result and to obtain a recording result with a high image quality.

Also, as described above, a recording head is provided with a nozzle ejecting a medium droplet other than nozzles ejecting a large droplet and a small droplet in the present embodiment. That is, in the present embodiment, a better gradation may be obtained and also image unevenness may be suppressed by a configuration with a best arrangement of large, medium, and small nozzles which has an effect of filling a space between large droplets with a medium droplet when a recording head is tilted.

Thus, in a recording head provided with nozzles ejecting three types of droplets, large, medium and small, nozzles are configured such that centers of nozzles with different ejection amounts are not arranged on a line in the main scanning direction, resulting in that a white line and a recording unevenness are not caused and a recording result with a high image quality can be obtained.

Second Embodiment

Figure 7:
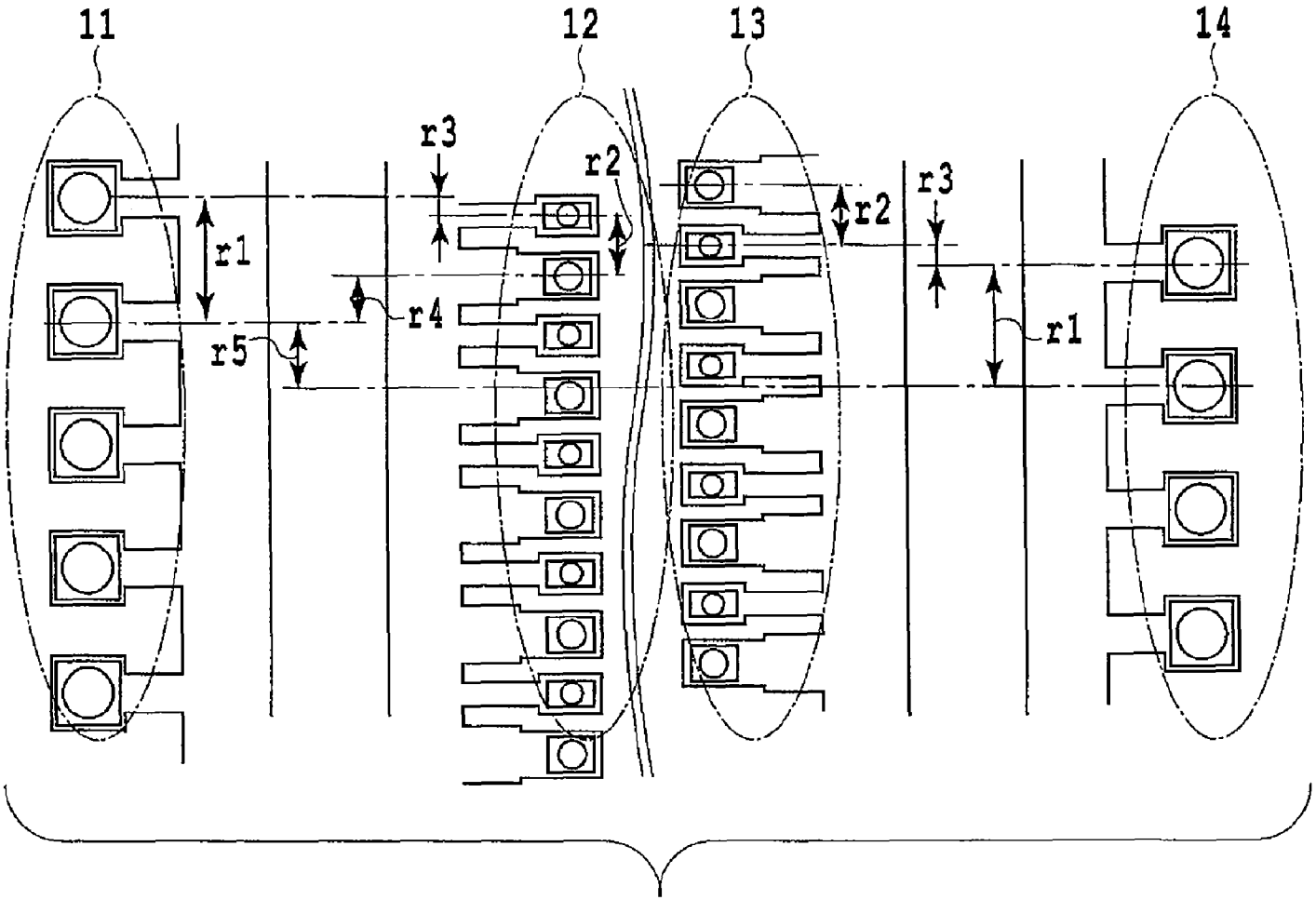
FIG. 7 is an enlarged view of a recording head in a second embodiment.
Figure 8:
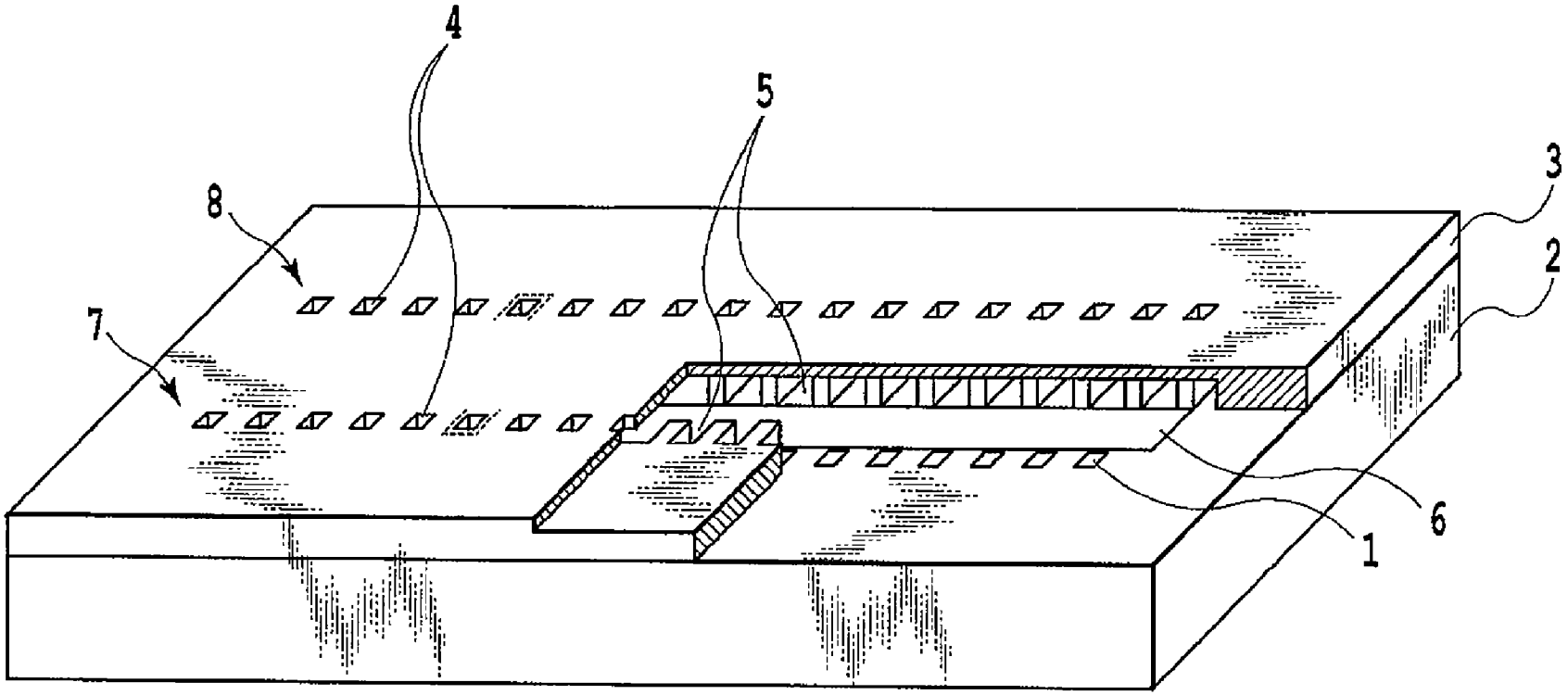
FIG. 8 is a perspective view of a conventional ink jet recording head, a part of which being cut out.
Figure 9:
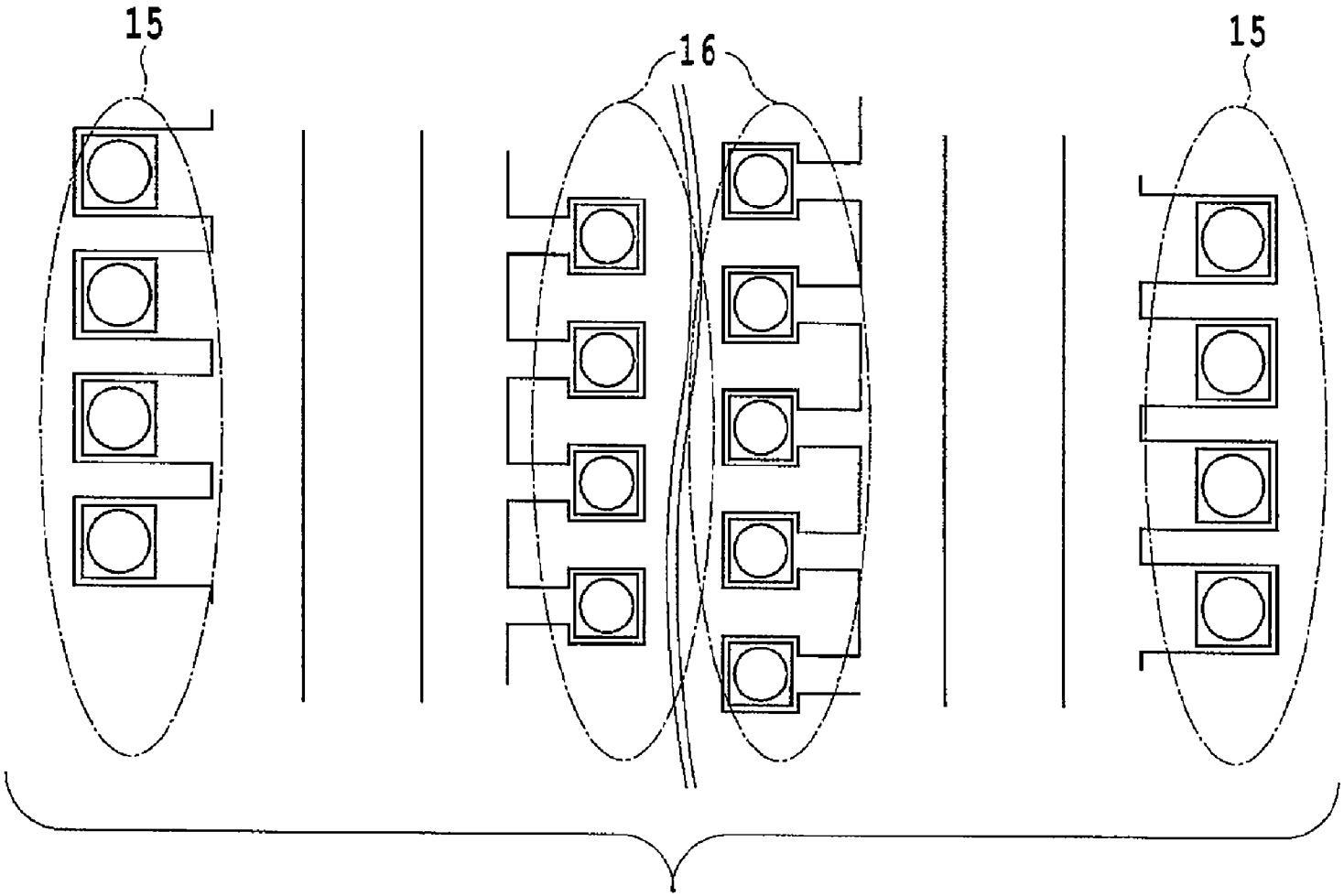
FIG. 9 is a diagram showing a nozzle arrangement disclosed in Japanese Patent Laid-Open No. H4-10940.
Figure 10:
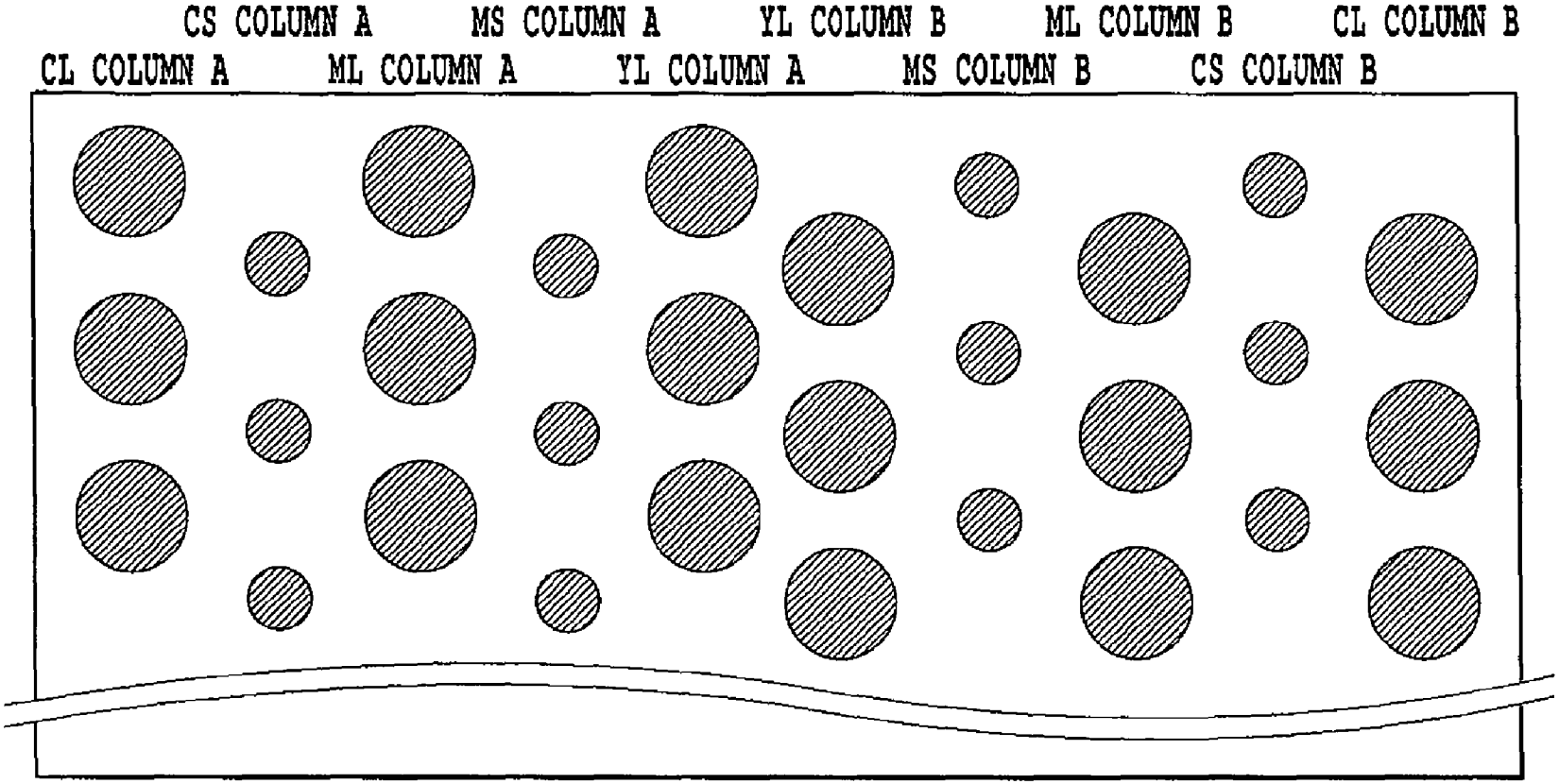
FIG. 10 is a plan view showing a nozzle arrangement state of two types of nozzles, large and small, arranged in the main scanning direction.
Figure 11A:
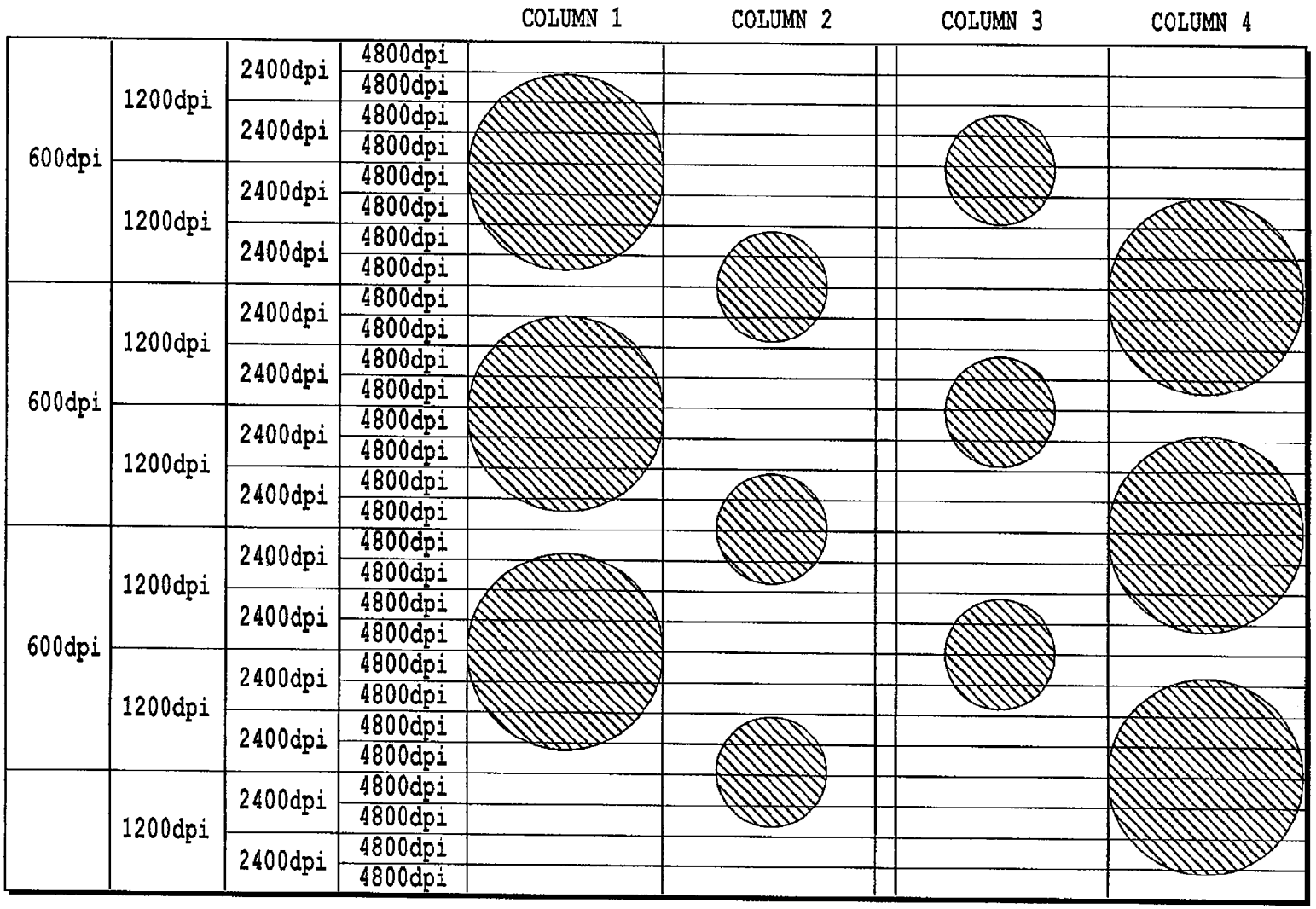
FIG. 11A is a diagram showing a positional relationship of landed ink droplets, column by column.
Figure 11B:
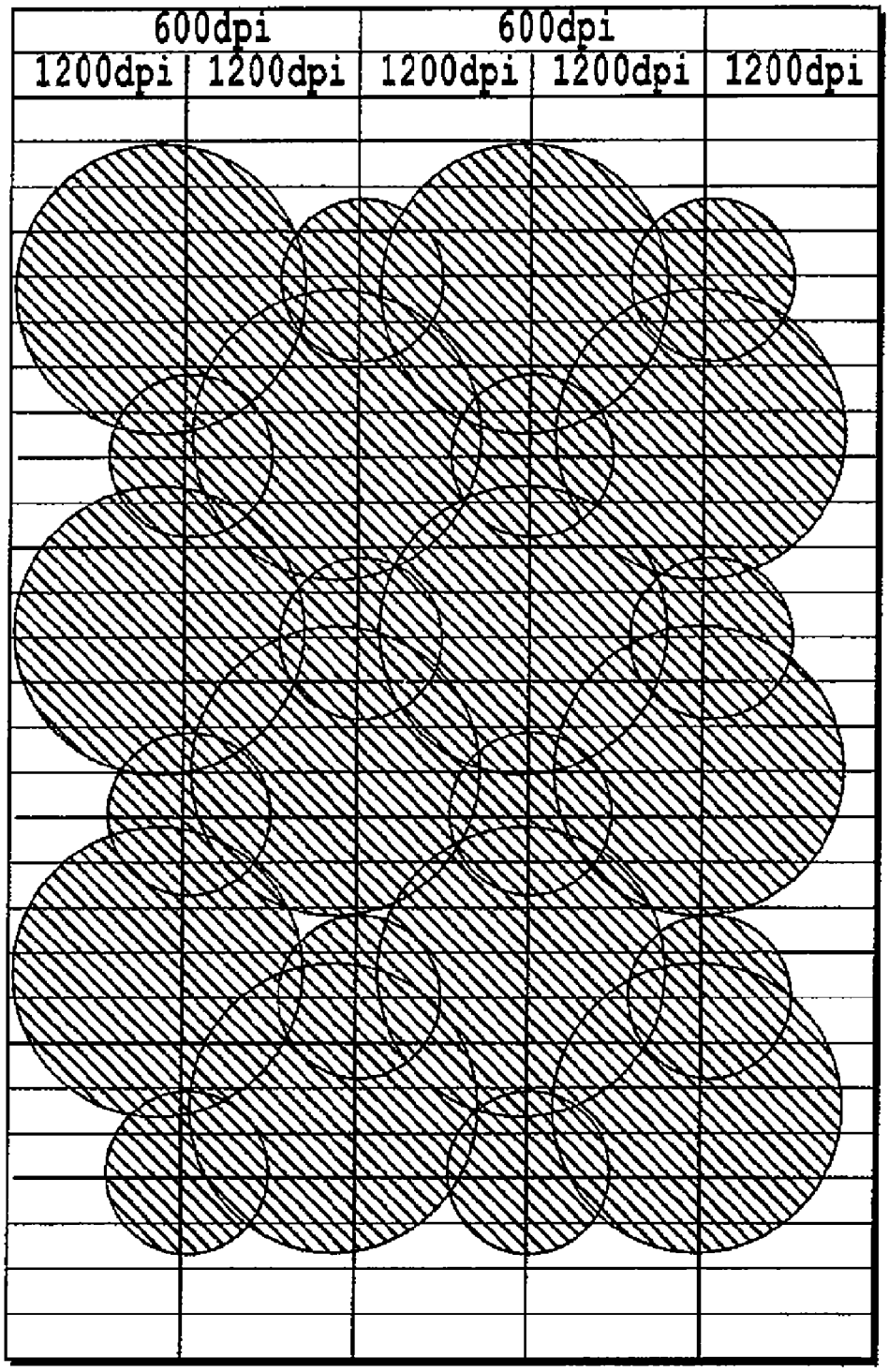
FIG. 11B is a diagram showing landed ink droplets when the recording head is not tilted.
Figure 11C:
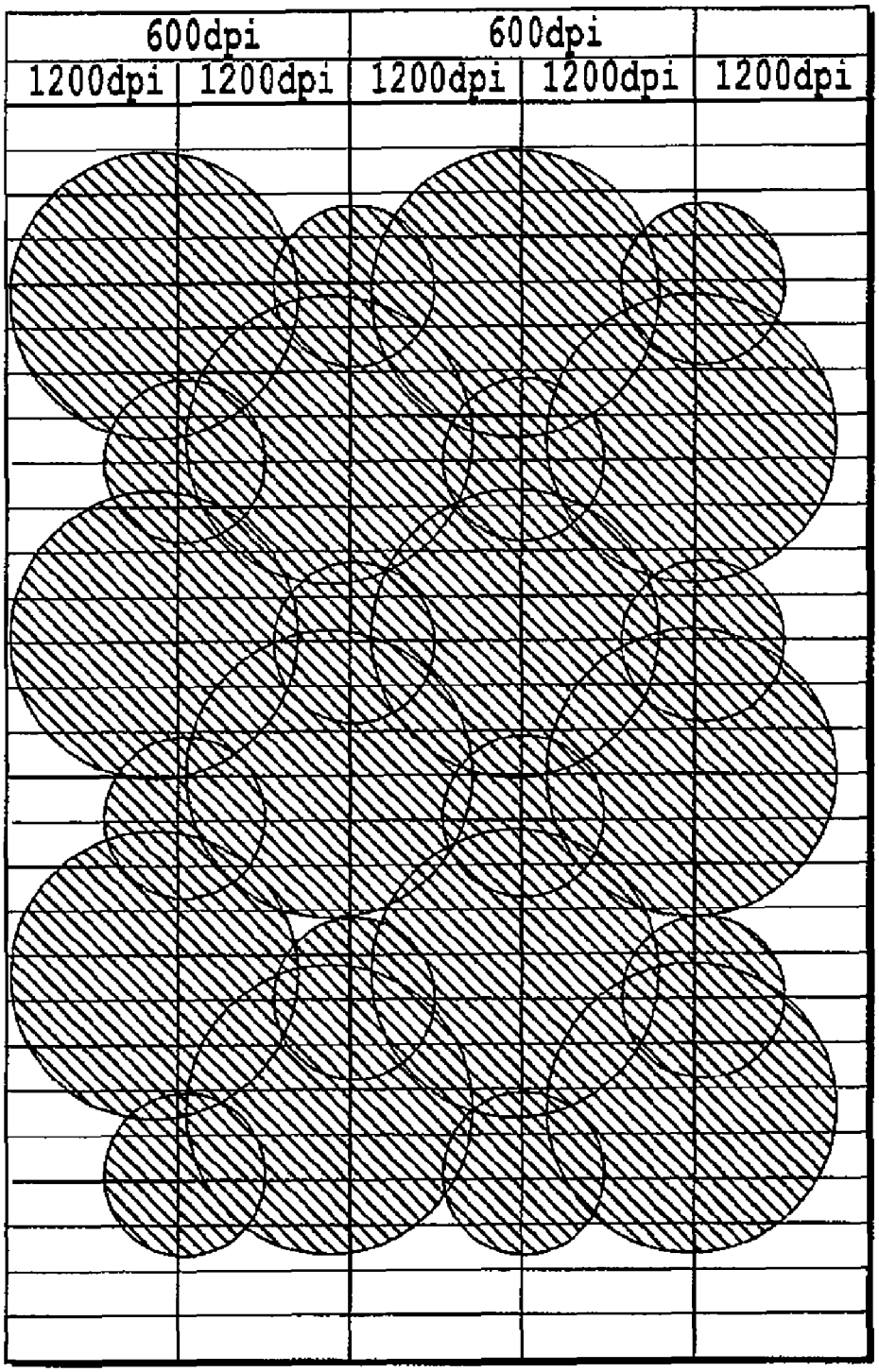
FIG. 11C is a diagram showing a positional relationship of landed ink droplets, column by column, when a recording is performed with the recording head tilted.
Figure 11D:
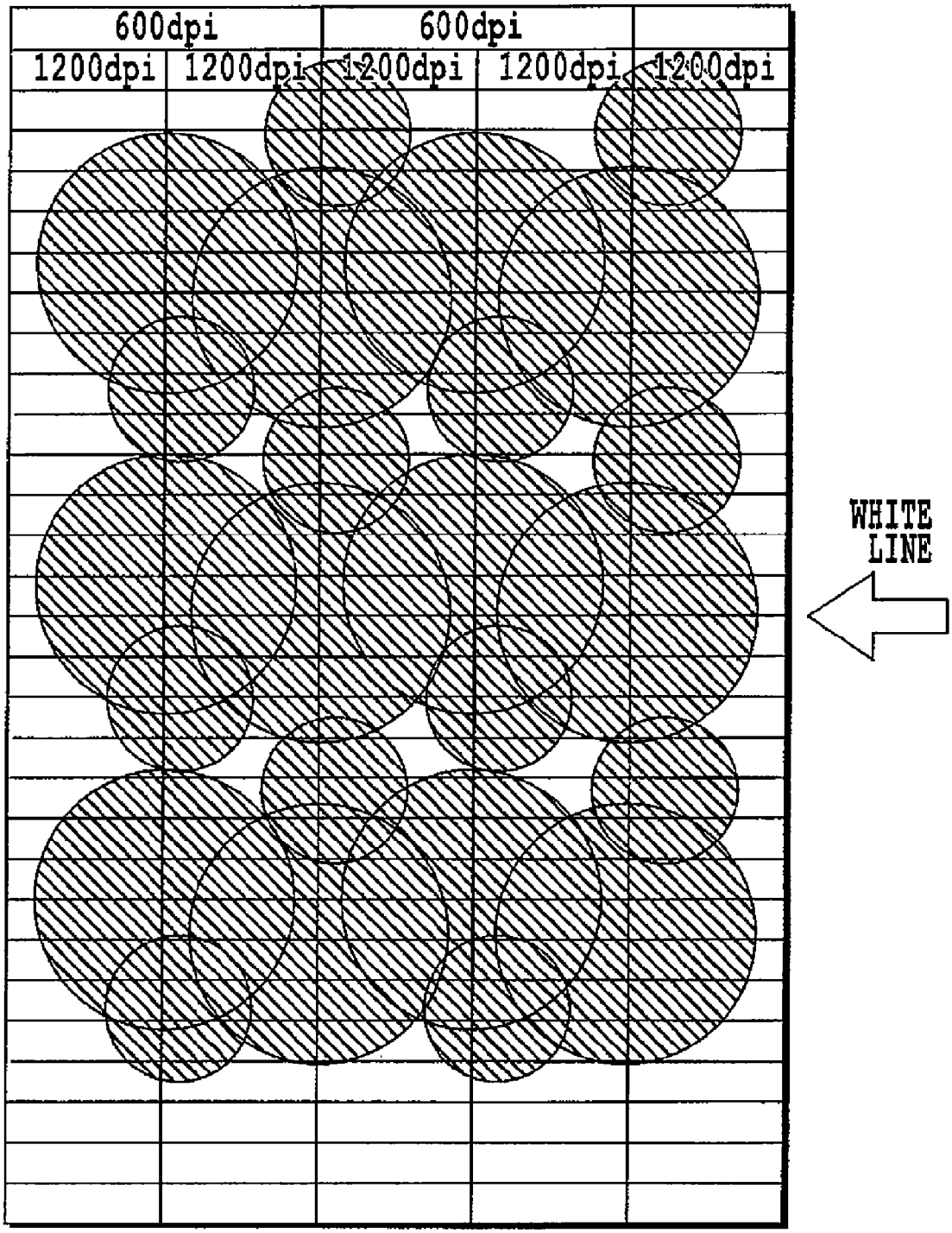
FIG. 11D is a diagram showing an appearance of landed ink droplets when the recording head is in a tilted state.

FIG. 7 is a diagram showing an arrangement of each nozzle, enlarged for easy understanding, in a recording head according to the present embodiment. A configuration is similar to that of the recording head shown in FIG. 5, and includes a heater, an element substrate, a flow path forming substrate, a nozzle, a separation wall, an ejector, etc. However, a point different from the first embodiment is that nozzles ejecting a small droplet and medium droplet are not arranged in a staggered manner. A small nozzle ejecting a small droplet and a medium nozzle ejecting a medium droplet are arranged on a line alternately like nozzle columns 12 and 13 in the drawing. A pitch r2 of small nozzles and medium nozzles is 21.2 μm, approximately a half of a pitch r1 (42.3 μm) of large nozzles arranged in a nozzle column 11 and nozzle column 14. Also, the nozzle pitch r2 of small nozzles in the nozzle column 12 is shifted against the nozzle pitch r1 in the nozzle column 11, and an offset amount thereof r3 is 15.9 μm. Also, the nozzle column 14 has an offset against the nozzle column 11 and an offset amount thereof r5 is 21.2 μm (1,200 dpi). Shifting each nozzle arrangement in this manner realizes a configuration in which a large nozzle does not overlap with a medium nozzle and small nozzle in the main scanning direction.

Also, compared with a small nozzle and medium nozzle in the first embodiment, a small nozzle and medium nozzle in the present embodiment are configured to have a smaller size. By a configuration of a smaller size of a small nozzle and medium nozzle, a small nozzle and medium nozzle can be arranged on a line alternately. This is similar for nozzle positions in the nozzle column 13 and the nozzle column 14.

A small nozzle and medium nozzle are smaller in nozzle diameters than those in the first embodiment, and a ratio of an area filled with ink droplets on a recording medium in a recording result is also smaller in the present embodiment than that in the first embodiment. In a recording result with a tilted recording head, however, the size of a small droplet and medium droplet is large enough to fill a space between large droplets. Therefore, also in a recording result by a recording head according to the present embodiment, a white line and a recording unevenness are not caused and a recording result with a high image quality can be obtained as in the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-304174, filed Nov. 9, 2006, which is hereby incorporated by reference herein in its entirety.

What is claimed is:

1. An ink jet recording head movable in a main scanning direction and provided with a plurality of nozzles capable of ejecting ink, the nozzles being arranged in the main scanning direction and in a sub-scanning direction crossing the main scanning direction, said plurality of nozzles comprising first, second, and third nozzles in order of largest ink ejection capacity to smallest, wherein:

said first nozzles form a nozzle column at one end and a nozzle column at the other end located apart from each other in the main scanning direction, said second nozzles and said third nozzles form middle nozzle columns located between said nozzle column at the one end and said nozzle column at the other end, a pitch in the sub-scanning direction of said second nozzles and said third nozzles forming said middle nozzle columns is smaller than that of said first nozzles forming said nozzle column at the one end and said nozzle column at the other end, centers of said first nozzles forming said nozzle column at the one end and centers of said first nozzles forming said nozzle column at the other end are shifted relative to each other in the sub-scanning direction, centers of said first, second, and third nozzles are shifted relative to each other in the sub-scanning direction, said first nozzles and said third nozzles are shifted in the sub-scanning direction by one-quarter of a pitch of said second nozzles and said third nozzles, and said first nozzles and said second nozzles are shifted in the sub-scanning direction by three-quarters of a pitch of said second nozzles and said third nozzles.

2. The ink jet recording head according to claim 1, wherein said middle nozzle columns include a first middle nozzle column and a second middle nozzle column in which said second nozzles and said third nozzles are arranged alternately.

3. The ink jet recording head according to claim 2, wherein a distance between said nozzle column at the one end and said first middle nozzle column is the same as a distance between said nozzle column at the other end and said second middle nozzle column.

4. The ink jet recording head according to claim 3, wherein the distance is not longer than one tenth of a distance between said nozzle column at the one end and said nozzle column at the other end.

5. The ink jet recording head according to claim 2, wherein:

said second nozzles and said third nozzles included in said first middle nozzle column form a different nozzle column; and said second nozzles and said third nozzles included in said second middle nozzle column form another different nozzle column.

6. The ink jet recording head according to claim 1, wherein each of the pitch in the sub-scanning direction between said second nozzles included in said middle nozzle columns and the pitch of said third nozzles included in said middle nozzle columns is a half of the pitch of the first nozzles forming said nozzle column at the one end and the pitch of said first nozzles forming said nozzle column at the other end.

7. The ink jet recording head according to claim 1, wherein an ink ejection amount ejected from said first nozzles is not less than two times that ejected from any one of said second nozzles and said third nozzles.

8. The ink jet recording head according to claim 1, wherein said first, second, and third nozzles eject the same ink.

9. An ink jet recording apparatus comprising a carriage which can mount an ink jet recording head capable of ink ejection to record an image on a recording medium with a movement of said carriage, wherein said carriage can mount an ink jet recording head according to claim 1.

* * * * *